US007950099B1

(12) United States Patent
Hanson et al.

(10) Patent No.: US 7,950,099 B1
(45) Date of Patent: May 31, 2011

(54) CAULK WORKING SYSTEMS AND METHODS WITH INTEGRATED CUTTING TOOL

(75) Inventors: Randal W. Hanson, Bellingham, WA (US); Wilfred J. Hoffmann, Fort Smith, AR (US); Gloria Hoffmann, legal representative, Fort Smith, AR (US)

(73) Assignee: Homax Products, Inc., Bellingham, WA (US)

( * ) Notice: Subject to any disclaimer, the term of this patent is extended or adjusted under 35 U.S.C. 154(b) by 838 days.

(21) Appl. No.: 11/899,908

(22) Filed: Sep. 7, 2007

Related U.S. Application Data

(60) Provisional application No. 60/843,455, filed on Sep. 7, 2006.

(51) Int. Cl.
*E04F 21/16* (2006.01)
*B05C 17/10* (2006.01)

(52) U.S. Cl. ..... 15/105; 15/235.7; 15/245.1; 7/105; 7/158; 30/123; 425/458

(58) Field of Classification Search ..... 15/105, 15/235.4–235.8, 236.01, 236.05–236.09, 15/245, 245.1; 425/458; 30/123, 124, 136, 30/143, 169; 7/105, 158
See application file for complete search history.

(56) References Cited

U.S. PATENT DOCUMENTS

| | | | | |
|---|---|---|---|---|
| 912,028 | A | 2/1909 | Prout | |
| 1,390,126 | A | 9/1921 | Halaska, Jr. | |
| 1,401,457 | A * | 12/1921 | Beuckmann | 15/245 |
| 1,436,254 | A | 11/1922 | Henry | |
| 1,602,642 | A | 10/1926 | Brathwaite | |
| 1,919,865 | A * | 7/1933 | Schacht | 15/245 |
| 2,046,599 | A * | 7/1936 | Andrews | 15/245 |
| 2,188,114 | A * | 1/1940 | Hubbard | 15/245 |
| 2,271,285 | A | 1/1942 | Bussert | |
| 2,280,225 | A * | 4/1942 | Finely | 15/245 |
| 2,528,911 | A | 11/1950 | Porter | |
| 2,674,005 | A | 4/1954 | Simon | |

(Continued)

FOREIGN PATENT DOCUMENTS

WO 00/10446 * 3/2000

OTHER PUBLICATIONS

Homax, Caulk Finisher Product, Website http://www.homaxproducts.com/products/kitchenbath/01/index.html, 1988.

*Primary Examiner* — Mark Spisich
(74) *Attorney, Agent, or Firm* — Michael R. Schacht; Schacht Law Office, Inc.

(57) ABSTRACT

A caulk working tool for working caulk against first and second surfaces defining an intersection comprising a shaft member and a scraper body. The shaft member is substantially rigid, and scraper body is substantially resilient. The scraper body is molded over the shaft member and comprises a scraper surface defining a point and first and second sides. The scraper body deforms when the first and second sides are held in contact with the first and second surfaces. The caulk working tool is displaced relative to the first and second surfaces while the first and second sides are in contact with the first and second surfaces to cause the scraper surface to work the caulk against the first and second surfaces and form a desired profile in the caulk.

19 Claims, 6 Drawing Sheets

U.S. PATENT DOCUMENTS

| | | | |
|---|---|---|---|
| 2,715,750 | A | 8/1955 | Vail |
| 3,087,654 | A | 4/1963 | Moore |
| 3,688,401 | A | 9/1972 | Harman |
| 3,744,079 | A | 7/1973 | Krause |
| 3,761,992 | A | 10/1973 | Schneller |
| 3,846,060 | A | 11/1974 | Otis |
| 3,878,581 | A | 4/1975 | Perna |
| 3,892,039 | A | 7/1975 | Fisher |
| 4,211,501 | A | 7/1980 | Pedroso et al. |
| 4,230,356 | A | 10/1980 | O'Connor |
| 4,295,242 | A | 10/1981 | Dixon |
| 4,338,718 | A | 7/1982 | Olkkola |
| 4,586,890 | A | 5/1986 | Marchbanks |
| 4,654,919 | A | 4/1987 | Liberman |
| 4,934,854 | A | 6/1990 | Vesely et al. |
| 5,008,970 | A | 4/1991 | Tsai |
| 5,018,956 | A | 5/1991 | Lemaster |
| 5,033,951 | A | 7/1991 | Cook |
| D326,593 | S | 6/1992 | Ward |
| D332,901 | S | 2/1993 | Campbell |
| 5,351,357 | A | 10/1994 | Liberman |
| 5,437,074 | A | 8/1995 | White et al. |
| 5,440,776 | A | 8/1995 | Kartler |
| D362,604 | S | 9/1995 | White et al. |
| 5,675,860 | A | 10/1997 | Campbell |
| D420,882 | S | 2/2000 | Majolo et al. |
| 6,035,536 | A | 3/2000 | Dewberry |
| 6,219,878 | B1 | 4/2001 | Dewberry |
| 6,351,888 | B1 | 3/2002 | Brown et al. |
| D468,980 | S | 1/2003 | Woods |
| 6,578,229 | B1 | 6/2003 | Dziallas et al. |
| 6,880,198 | B1 | 4/2005 | Hazard |

* cited by examiner

CAULK WORKING SYSTEMS AND METHODS WITH INTEGRATED CUTTING TOOL

RELATED APPLICATIONS

This application claims priority of U.S. Provisional Patent Application Ser. No. 60/843,455 filed Sep. 7, 2006, the contents of which are incorporated herein by reference.

TECHNICAL FIELD

The present invention relates caulk working systems and, more specifically, to systems and methods adapted to facilitate the working of caulk at the juncture of two surfaces.

BACKGROUND OF THE INVENTION

In certain environments, a seal must be formed between two adjacent surfaces. As one example, vertical laminate surface may form an intersection with a horizontal laminate surface to define a wall and floor, respectively, of a shower stall. To prevent water from leaking between the intersection defined by the two surfaces, a bead of caulk may be applied along the intersection. Caulk is applied in a plastic form and dries to form a somewhat tacky or adhesive body that is also somewhat flexible. Although flexible, dried caulk is no longer plastic.

For aesthetic reasons, caulk is often worked after the bead is formed and before the caulk dries to obtain a desired profile. The desired profile may be a concave or "cove" surface or may be a convex or "rounded" surface. The use of a finger to work caulk can be messy and not result in a desired profile. In addition, while a finger can be used to create a concave surface, convex surfaces typically require the use of a tool.

The need exists for improved tools for working caulk.

SUMMARY OF THE INVENTION

The present invention may be, embodied as a caulk working tool for working caulk against first and second surfaces defining an intersection comprising a shaft member and a scraper body. The shaft member is substantially rigid, and scraper body is substantially resilient. The scraper body is molded over the shaft member and comprises a scraper surface defining a point and first and second sides. The scraper body deforms when the first and second sides are held in contact with the first and second surfaces. The caulk working tool is displaced relative to the first and second surfaces while the first and second sides are in contact with the first and second surfaces to cause the scraper surface to work the caulk against the first and second surfaces and form a desired profile in the caulk.

DETAILED DESCRIPTION OF THE PREFERRED EMBODIMENT

Figure 1:
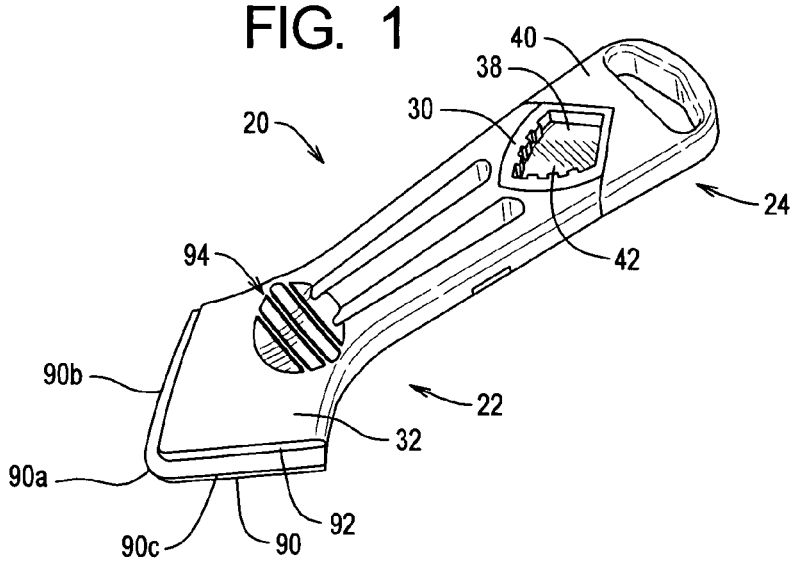
FIG. 1 is a perspective view of one example of a caulk working assembly of the present invention.

Referring initially to FIGS. 1-10, depicted therein is an example caulk working assembly 20 constructed in accordance with, and embodying, the principles of the present invention. As perhaps best shown in FIGS. 7 and 8, the caulk working assembly 20 comprises a scraping subassembly 22 and a cutting subassembly 24.

The example scraping subassembly 22 comprises a shaft member 30 and a scraper body 32. The example shaft member 30 is made of relatively rigid material, and the example scraper body 32 is a relatively resilient material that is molded over the shaft member 30. The shaft member 30 defines blade slots 34*a* and 34*b*, a retaining slot 36, and a blade opening 38.

The example cutting subassembly 24 comprises a cap member 40 and a blade member 42. The cap member 40 supports the blade member 42 in a desired relationship to one or more retaining projections 44 such as the retaining projections 44*a* and 44*b* in FIG. 7. The blade member 42 defines a blade edge 46 that in turn defines a blade point 48. In the example caulk working assembly 20, the retaining slot 36 is configured to receive the example retaining projections 44-44*a* and 44*b* such that the cutting subassembly 24 can be detachably attached to the scraping subassembly 22.

Figure 5:
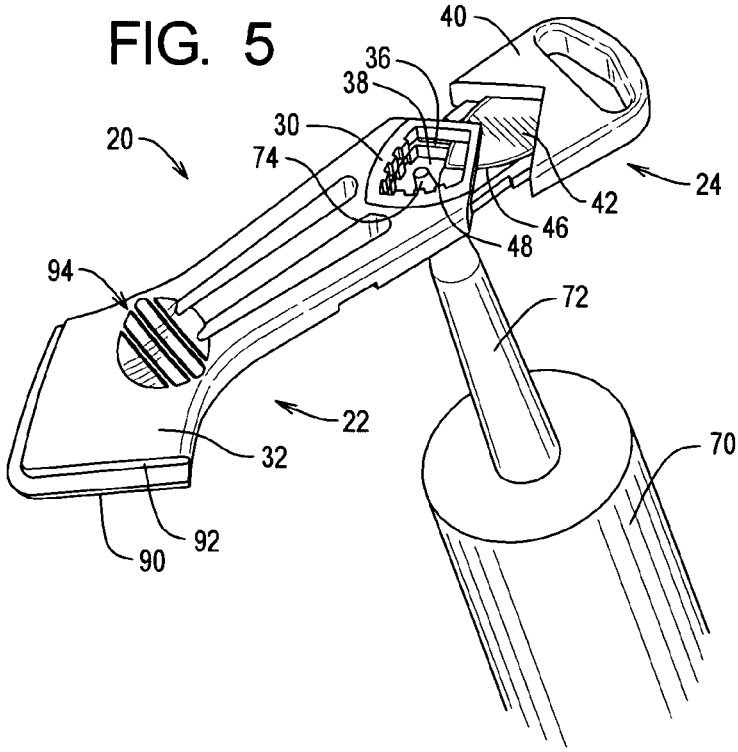
FIG. 5 is a perspective view illustrating the caulk working assembly of FIG. 1 in a second configuration as used in a second mode to cut a tip of a caulking tube.
Figure 6:
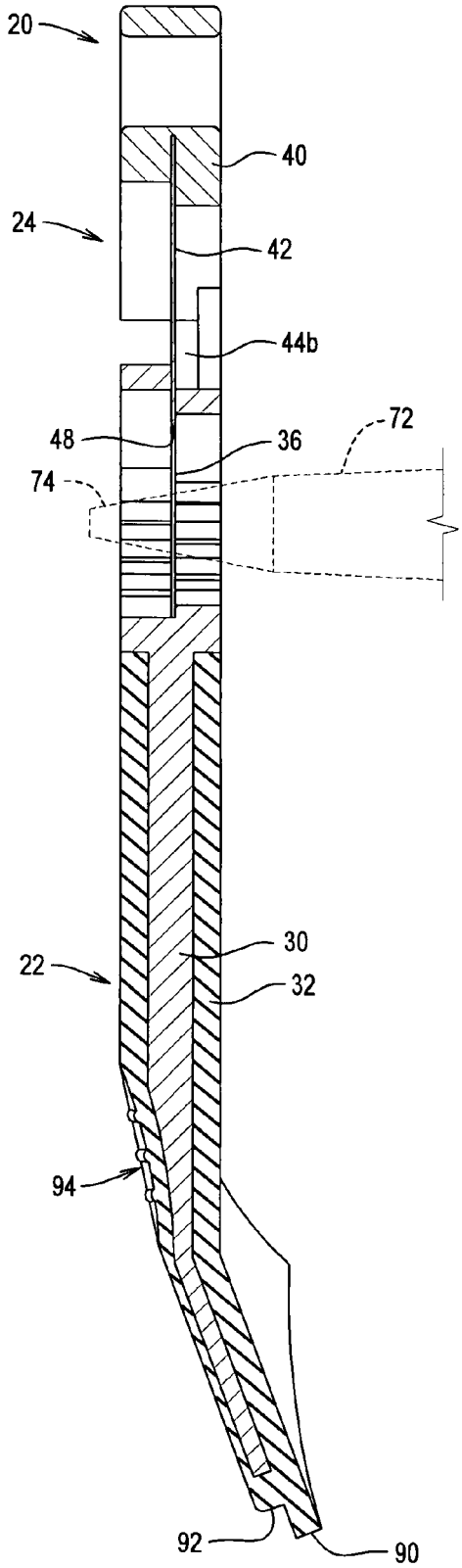
FIG. 6 is a side elevation, cut-away view of the caulk working assembly in the second configuration.
Figure 7:
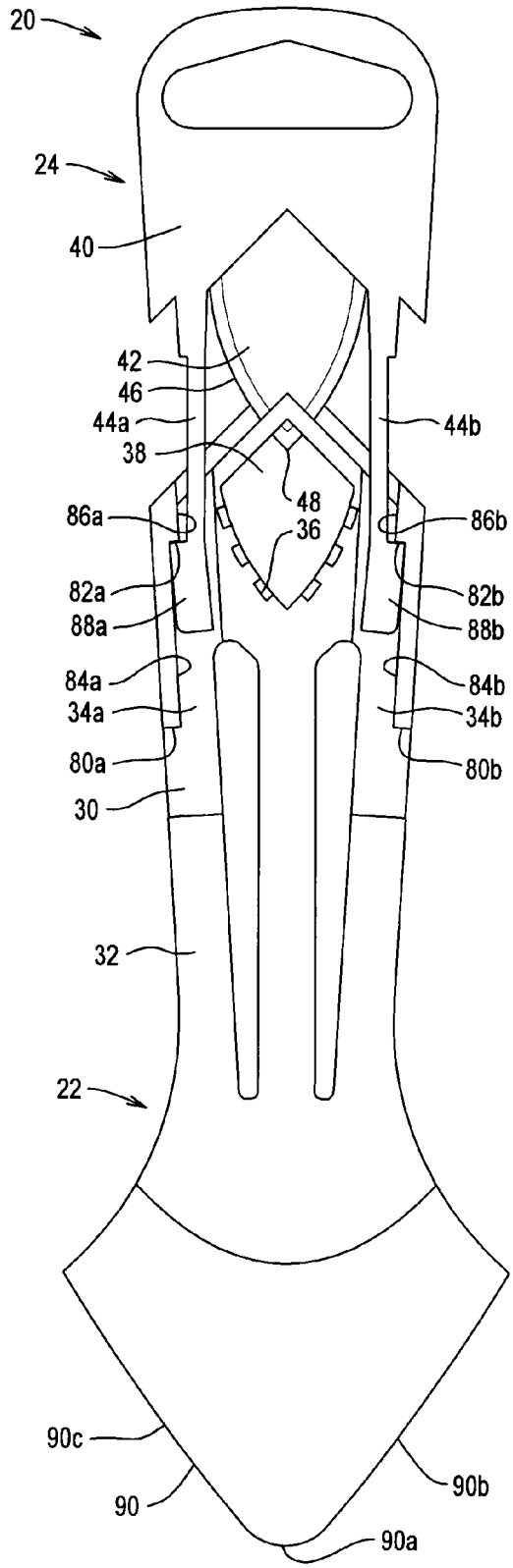
FIG. 7 is a bottom plan view of the caulk working assembly of FIG. 1 in the second configuration.
Figure 8:
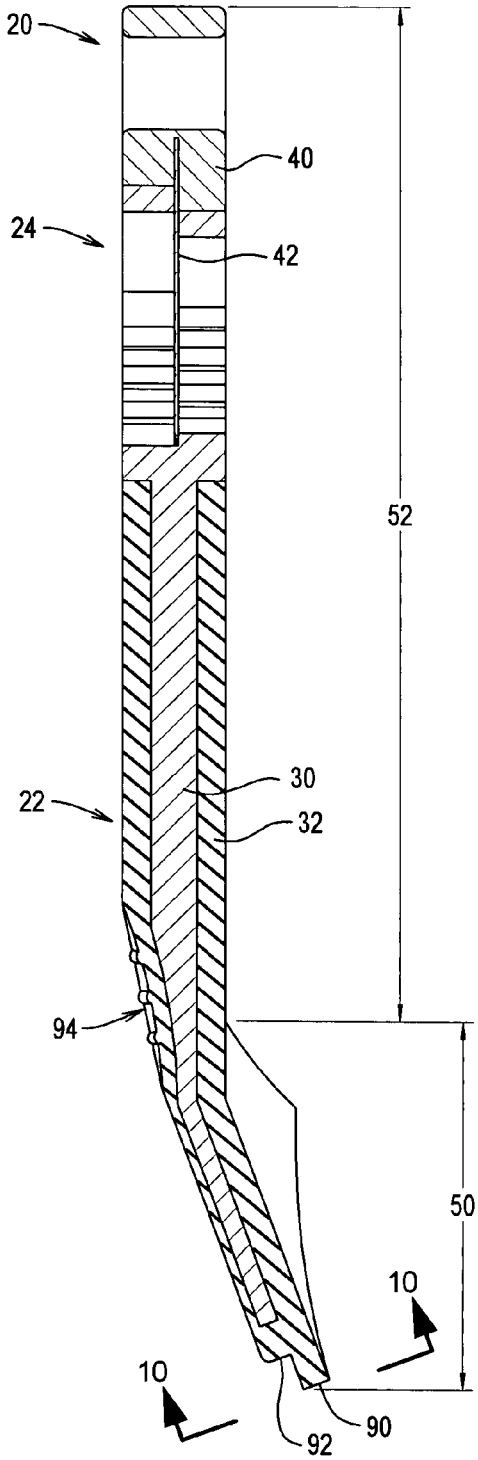
FIG. 8 is a side elevation, cut-away view of the caulk working assembly in the first configuration.
Figure 9:
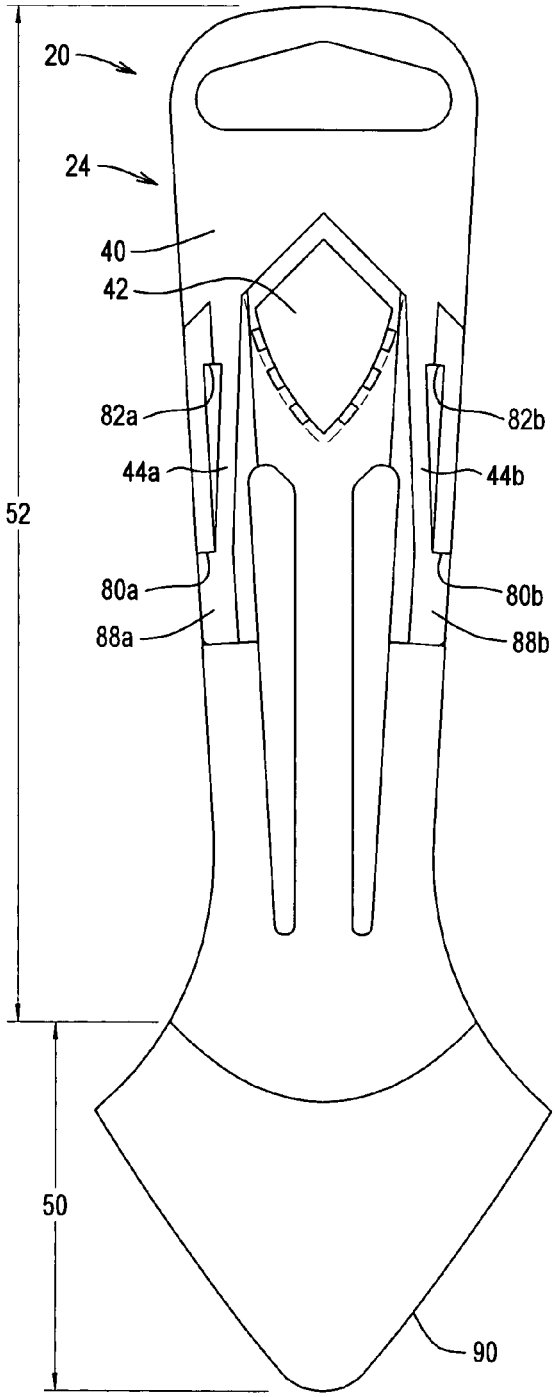
FIG. 9 is a bottom plan view of the caulk working assembly of FIG. 1 in the first configuration.
Figure 10:
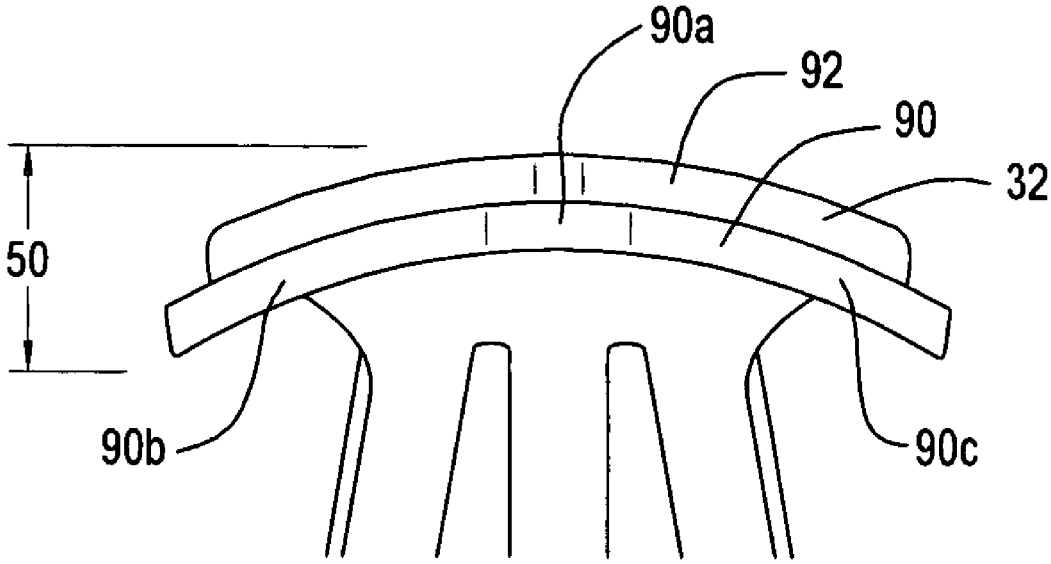
FIG. 10 is an end view of the caulk working assembly of FIG. 1 illustrating a caulking tip portion thereof.

More specifically, the retaining slot 36 and the example retaining projections 44 44*a* and 44*b* are configured such that, when the cutting subassembly 24 is attached to the scraping subassembly 22, the cutting subassembly 24 may be in a first position relative to the scraping subassembly 22 (FIGS. 1, 2, 8, and 9) or in a second position relative to the scraping subassembly 22 (FIGS. 5 and 7). The cutting subassembly 24 may be moved relative to the scraping subassembly 22 between these first and second positions as will be described in further detail below. In addition, the cutting subassembly 24 may be completely detached from the scraper subassembly 22.

With the cutting subassembly 24 in the first position, the caulk working assembly 20 is in a first configuration in which the cutting subassembly 24 and the scraping subassembly 22 are joined together. In this first configuration, the cap member 40 and the scraping subassembly 22 define a working portion 50 and a scraper handle portion 52.

Figure 2:
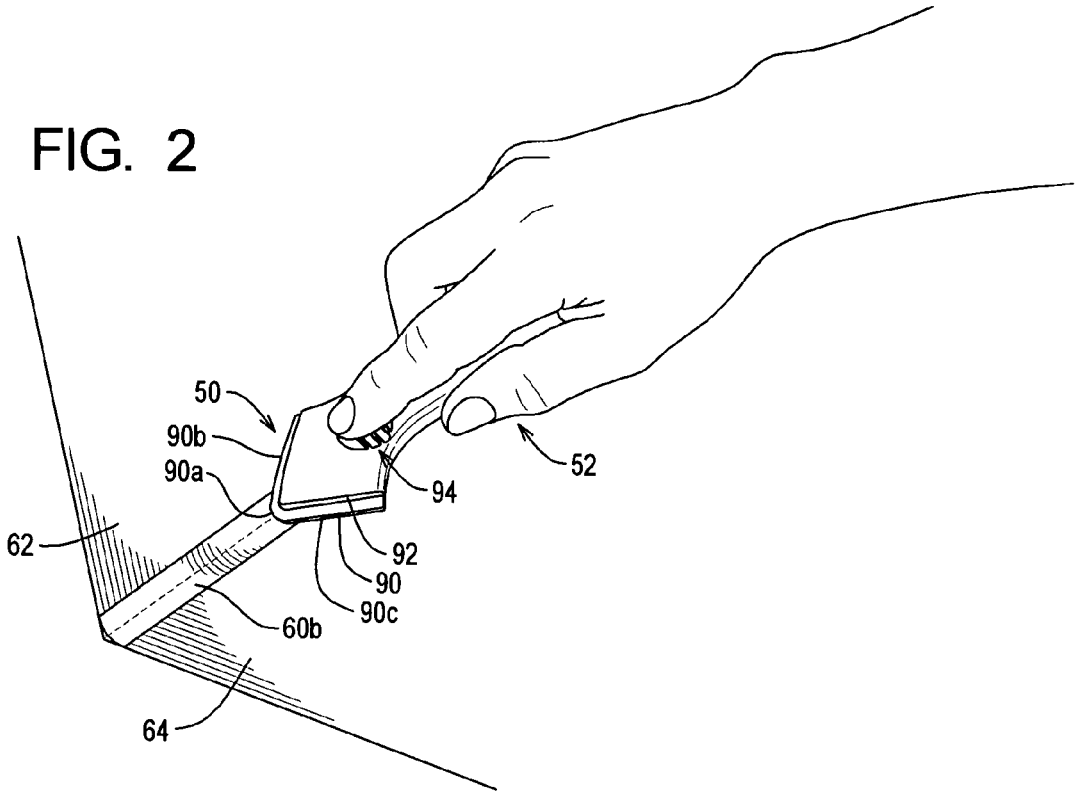
FIG. 2 is a perspective view illustrating the caulk working assembly of FIG. 1 in a first configuration as used in a first mode to work caulk at the juncture of two surfaces.
Figure 3:
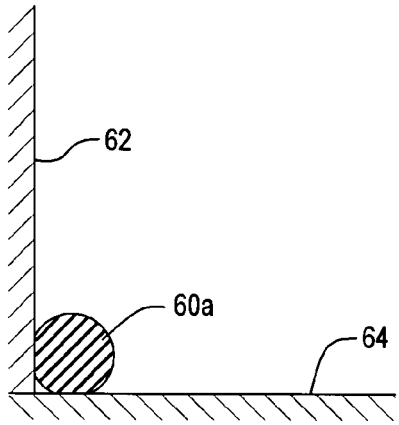
FIGS. 3 and 4 are elevation views depicting the use of the caulk working assembly of FIG. 1 in the first mode.
Figure 4:
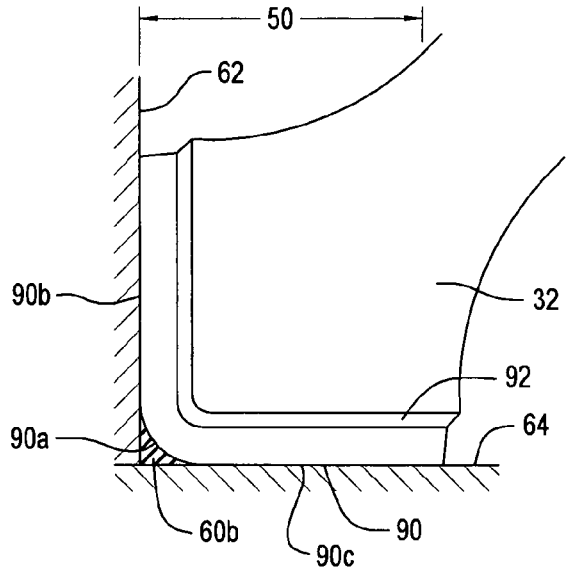

The scraper handle portion 52 is adapted to be gripped by a user as indicated in FIG. 2 of the drawing. As shown in FIG. 3, a bead of caulk 60*a* is laid at the juncture of first and second surfaces 62 and 64 as shown by reference character 60*a* in FIG. 3. Using the handle portion 52, the working portion 50 brought into contact with the caulk bead 60*a* and surfaces 62 and 64 as shown in FIGS. 2 and 4 and drawn along the juncture of these surfaces 62 and 64 to deform the bead of caulk 60*a* as shown at 60*b* in FIGS. 2 and 4. As will be described in further detail below, the working portion 50 is configured such that the deformed caulk bead 60*b* has a desirable profile.

With the cutting subassembly 24 in the second position, the caulk working assembly 20 is in a second configuration in which the cutting subassembly 24 and the scraping subassembly 22 are separated. In this second configuration, the blade member 42 is substantially withdrawn from the blade opening 38.

A conventional dispensing tube 70 having a tip portion 72 is depicted in FIG. 5. The dispensing tip portion 72 is typically formed with a distal portion 74 that seals the end of the tip portion 72. Until this distal portion 74 is removed, material cannot be dispensed from the dispensing tube 70. In the second configuration, the dispensing tube 70 may be displaced such that the distal portion 74 thereof extends at least partly through the blade opening 38 as shown in FIG. 5 and by dotted lines in FIG. 6. The cutting assembly 24 may then be displaced from the second position into the first position to cut off the distal portion 74 of the tip portion 72. At this point, the caulk working assembly 20 is in the first configuration and may be used to work the caulk bead 60*a* as described above.

The details of construction and operation of the example caulk working assembly 20 will now be described in further detail. As perhaps best shown in FIGS. 7 and 9, the shaft member 30 defines first and second blade slots 34*a* and 34*b*. The shaft member 30 further defines first stop surfaces 80*a* and 80*b* and second stop surfaces 82*a* and 82*b*. A first intermediate surface 84*a* extends between the stop surfaces 80*a* and 82*a*, while a second intermediate surface 84*b* extends between the stop surfaces 80*b* and 82*b*. A first inlet surface 86*a* terminates at the second stop surface 82*a*, while a second inlet surface 86*b* terminates at the second stop surface 82*b*.

The cap member 40 defines first and second retaining projections 44*a* and 44*b* each comprising an enlarged end portions 88*a* and 88*b*, respectively. The retaining projections 44*a* and 44*b* resiliently extend from the cap member 40 such that they may be displaced towards each other.

To detachably attach the cutting subassembly 24 to the scraping subassembly 22, the cutting assembly 24 is displaced relative to the subassembly 22 such that the end portions 88*a* and 88*b* of the retaining projections 44*a* and 44*b* come into contact with the inlet surfaces 86*a* and 86*b*, respectively. The inlet surfaces 86*a* and 86*b* are angled such that, with further displacement of the cutting subassembly 24 relative to the scraping subassembly 22, the inlet surfaces 86*a* and 86*b* engage the end portions 88*a* and 88*b* such that the retaining projections 44*a* and 44*b* are displaced towards each other.

When the end portions 88*a* and 88*b* reach the second stop surfaces 82*a* and 82*b*, the end portions 88*a* and 88*b* disengage from the inlet surfaces 86*a* and 86*b* and move outwardly. The end portions 88*a* and 88*b* thus engage the second stop surfaces 82*a* and 82*b* and the intermediate surfaces 84*a* and 84*b*, respectively. At this point, the cutting subassembly 24 is in the second position relative to the scraper subassembly 22, and the caulk working assembly 20 is in its second configuration.

The cutting assembly 24 is displaced relative to the subassembly 22 with the end portions 88*a* and 88*b* in contact with the intermediate surfaces 84*a* and 84*b*, respectively. The intermediate surfaces 84*a* and 84*b* are angled such that, with further displacement of the cutting subassembly 24 relative to the scraping subassembly 22, the intermediate surfaces 84*a* and 84*b* engage the end portions 88*a* and 88*b* such that the retaining projections 44*a* and 44*b* are again displaced towards each other.

When the end portions 88*a* and 88*b* reach the first stop surfaces 80*a* and 80*b*, the end portions 88*a* and 88*b* disengage from the intermediate surfaces 84*a* and 84*b* and move outwardly. The end portions 88*a* and 88*b* then engage the first stop surfaces 80*a* and 80*b*, respectively. At this point, the cutting subassembly 24 is in the first position relative to, and is attached to, the scraper subassembly 22, and the caulk working assembly 20 is in its first configuration.

To place the caulk working assembly 20 back into the second configuration, the end portions 88*a* and 88*b* are manually pinched towards each other so that they are disengaged from the first stop surfaces 80*a* and 80*b*. The cutting subassembly 24 then may be displaced relative to the scraper subassembly 22 until the end portions 88*a* and 88*b* engage the second stop surfaces 82*a* and 82*b*. The second stop surfaces 82*a* and 82*b* prevent inadvertently removal of the cutting subassembly 24 from the scraper subassembly 22. However, displacing the retaining projections 44*a* and 44*b* towards each other allows the end portions 88*a* and 88*b* to be disengaged from the second stop surfaces 82*a* and 82*b* if removal of the cutting subassembly 24 from the scraper subassembly 22 is desired.

Turning again to FIGS. 7 and 9 of the drawing, these figures illustrate that the scraper body 32 defines a scraper surface 90 that has a generally V-shaped configuration with a slightly rounded point 90*a*. In use, sides 90*b* and 90*c* of the "V" are adapted to engage the surfaces 62 and 64 such that only that caulk material that passes under the rounded point is left at the juncture of these surfaces 62 and 64. The exact shape of the scraper surface 90 is not critical and in fact can vary based on a desired profile of the worked caulk material 60*b*.

The scraper surface 90 is arranged slightly forward of an offset surface 92. The offset surface 92 represents the boundary of a relatively thicker portion of the scraper body 32 that extends beyond at least a portion of the shaft member 30. The shaft member 30 thus extends through the scraper body 32 up to approximately the offset surface 92, at which point the scraper body 32 narrows before reaching the scraper surface 90. The shaft member 30, which is relatively rigid, thus maintains the scraper body 32 in a desired shape except near the scraper surface 90, where the relatively resilient scraper body 32 may deform slightly. This deformation allows the scraper body 32 to be pressed firmly against the surfaces 62 and 64, thereby substantially preventing any caulk material being worked from passing between the sides of the "V" formed by the scraper surface 90 and the surfaces 62 and 64.

A pressure point 94 is defined by the scraper body 32 at a location on the caulk working assembly 20 where pressure should be applied when working the caulk material.

Figure 11:
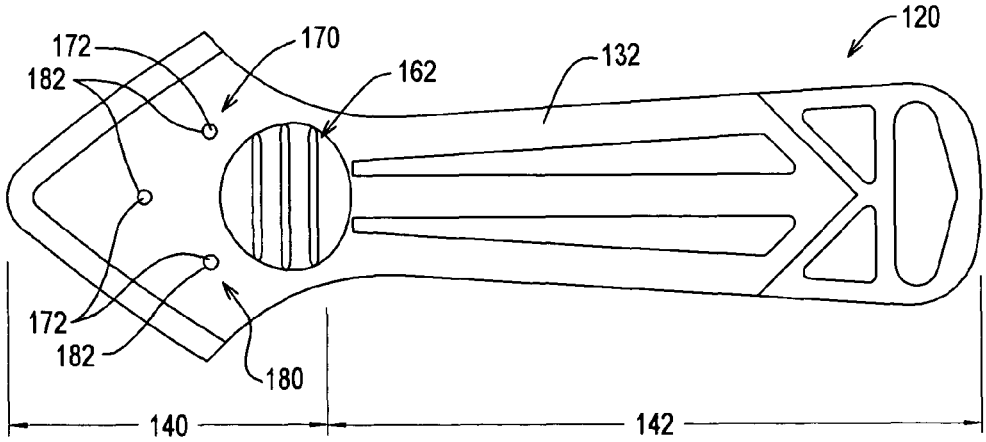
FIG. 11 is a top plan view of a second example caulk working assembly.
Figure 12:
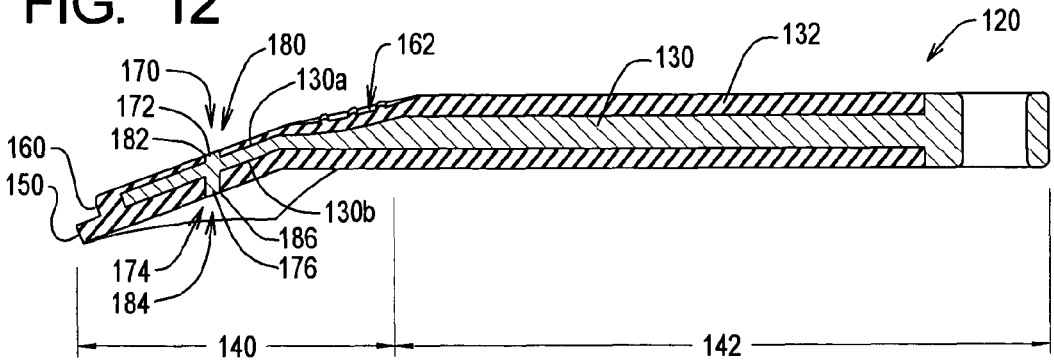
FIG. 12 is a side elevation cut-away view of the caulk working tool of FIG. 11.
Figure 13:
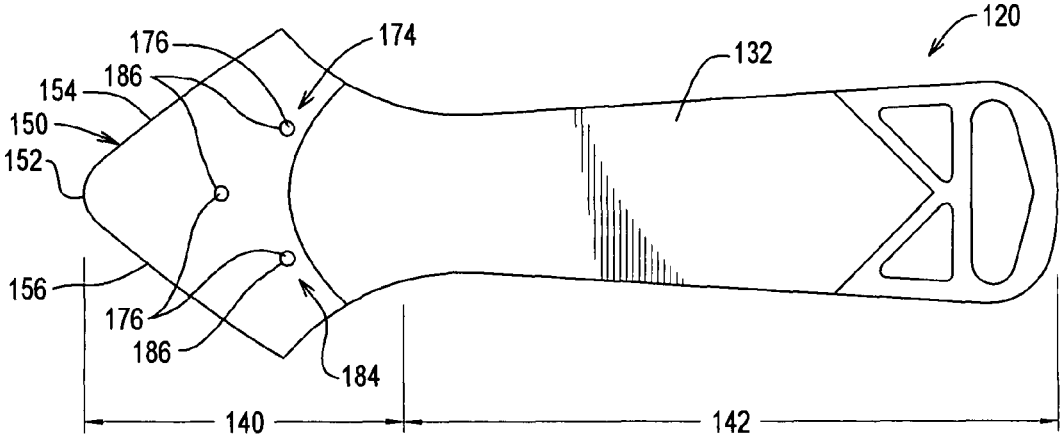
FIG. 13 is a bottom plan view of the caulk working assembly of FIG. 11.

Referring now to FIGS. 11-13, depicted therein is a second example caulk working assembly 120 constructed in accordance with, and embodying, the principles of the present invention. As perhaps best shown in FIG. 12, the caulk working assembly 120 comprises a shaft member 130 and a scraper body 132. The example shaft member 130 is made of relatively rigid material, and the example scraper body 132 is a relatively resilient material that is molded over the shaft member 130.

The caulk working assembly 120 defines a working portion 140 and a scraper handle portion 142. The scraper handle portion 142 is adapted to be gripped by a user. As described above with reference to the first example caulk working assembly 20, the working portion 140 is brought into contact with the caulk bead and corner surfaces using the handle portion 142. The caulk working assembly 120 is then drawn along the juncture of the corner surfaces to deform the bead of caulk. As described above, the working portion 140 is configured such that the deformed caulk bead has a desirable profile.

The details of construction and operation of the example caulk working assembly 120 will now be described in further detail. The scraper body 132 defines a scraper surface 150 that has a generally V-shaped configuration with a slightly rounded point 152. As described with reference to the first example caulk working assembly 20, first and second sides 154 and 156 defining the "V" shaped scraper surface 150 are adapted to engage corner surfaces, such as the surfaces 62 and 64 described above, such that only that caulk material that passes under the rounded point 152 is left at the juncture of these surfaces. The exact shape of the point 152 and sides 154 and 156 defining the scraper surface 150 is not critical and in fact can be selected or designed based on a desired profile of the worked caulk material.

The scraper surface 150 is arranged slightly forward of an offset surface 160. The offset surface 160 represents the boundary of a relatively thicker portion of the scraper body 132 that extends beyond at least a portion of the shaft member 130. The shaft member 130 thus extends through the scraper body 132 up to approximately the offset surface 160, at which point the scraper body 132 narrows before reaching the scraper surface 150.

The shaft member 130, which is relatively rigid, thus maintains the scraper body 132 in a desired shape except near the scraper surface 150, where the relatively resilient scraper body 132 may deform slightly. This deformation allows the scraper body 132 to be pressed firmly against the corner surfaces, thereby substantially preventing any caulk material being worked from passing between the sides of the "V" formed by the scraper surface 150 and the corner surfaces.

FIGS. 11 and 12 illustrate that a pressure point 162 is defined by the scraper body 132 at a location on the caulk working assembly 120 where pressure should be applied when working the caulk material.

FIGS. 11-13 illustrate that a first set 170 of first locator projections 172 and a second set 174 of second locator projections 176 extend from opposite surfaces 130*a* and 130*b* of the shaft member 130. Formed in the scraper body 132 are a first set 180 of first locator openings 182 and a second set 184 of second locator openings 186. The first set 180 of openings 182 receive the first set 170 of locator projections 172, while the second set 184 of openings 186 receive the second set 174 of locator projections 176. The projections 172 and 176 engage the openings 182 and 186 to inhibit movement of the scraper body 132 relative to the shaft member 130 during use of the example caulk working assembly 120.

From the foregoing, it should be apparent that the principles of the present invention may be embodied in forms other than those depicted herein. Accordingly, the scope of the present invention should not be limited to the specific embodiments described herein.

What is claimed is:

1. A caulk working tool for working caulk against first and second surfaces defining an intersection, comprising:

a shaft member, where the shaft member is substantially rigid; and a scraper body defining a first portion, a second portion, an offset surface at a boundary between the first and second portions, and a scraper surface defining a point and first and second sides, where the scraper body is substantially resilient, and is molded over the shaft member; whereby the first portion of the scraper body is relatively thicker than the second portion of the scraper body;

the shaft member lies substantially within the first portion of the scraper body up to approximately the offset surface;

the second portion of the scraper body deforms between the offset surface and the scraper surface when the first and second sides are held in contact with the first and second surfaces, and the caulk working tool is displaced relative to the first and second surfaces while the first and second sides are in contact with the first and second surfaces to cause the scraper surface to work the caulk against the first and second surfaces and form a desired profile in the caulk.

2. A caulk working tool as recited in claim 1, in which the shaft member and the scraper body form a scraping subassembly, further comprising a cutting subassembly.

3. A caulk working tool as recited in claim 2, in which the cutting subassembly may be moved between first and second positions relative to the scraping subassembly.

4. A caulk working tool as recited in claim 3, in which:

the cutting subassembly comprises a blade defining an edge;

the edge of the blade is not exposed when the cutting subassembly is in the first position; and the edge of the blade is exposed when the cutting subassembly is in the second position.

5. A caulk working tool as recited in claim 4, in which:

the shaft member defines a blade slot; and the edge of the blade is within the blade slot when the cutting subassembly is in the first position.

6. A caulk working tool as recited in claim 5, in which:

the shaft member defines a blade opening; and the edge of the blade is within the blade opening when the cutting subassembly is in the second position.

7. A caulk working tool as recited in claim 4, in which:

the shaft member defines a blade opening; and the edge of the blade is within the blade opening when the cutting subassembly is in the second position.

8. A caulk working tool as recited in claim 3, further comprising:

at least one retaining slot formed in one of the shaft member and the cutting subassembly; and at least one retaining projection formed in another of the shaft member and the cutting subassembly.

9. A caulk working tool as recited in claim 1, in which:

at least one locator projection extends from the shaft member; and at least one locator opening is formed in the scraper body; whereby the at least one locator projection engages the at least one locator opening to inhibit movement of the scraper body relative to the shaft member.

10. A caulk working tool as recited in claim 1, in which:

a plurality of locator projections extend from the shaft member; and a plurality of locator openings is formed in the scraper body; whereby the locator projections engage the locator openings to inhibit movement of the scraper body relative to the shaft member.

11. A caulk working tool for working caulk against first and second surfaces defining an intersection, comprising:

a shaft member, where the shaft member is substantially rigid, and at least one locator projection extends from the shaft member; and a scraper body defining a first portion, a second portion, an offset surface at a boundary between the first and second portions, and a scraper surface defining a point and first and second sides, where the scraper body is substantially resilient, is molded over the shaft member, and at least one locator opening is formed in the scraper body; whereby the at least one locator projection engages the at least one locator opening to inhibit movement of the scraper body relative to the shaft member;

the first portion of the scraper body is relatively thicker than the second portion of the scraper body;

the shaft member lies substantially within the first portion of the scraper body up to approximately the offset surface;

the second portion of the scraper body deforms between the offset surface and the scraper surface when the first and second sides are held in contact with the first and second surfaces, and displacing the caulk working tool relative to the first and second surfaces while the first and second sides are in contact with the first and second surfaces causes the scraper surface to work the caulk against the first and second surfaces and form a desired profile in the caulk.

12. A caulk working tool as recited in claim 11, in which the shaft member and the scraper body form a scraping subassembly, further comprising a cutting subassembly.

13. A caulk working tool as recited in claim 12, in which the cutting subassembly may be moved between first and second positions relative to the scraping subassembly.

14. A caulk working tool as recited in claim 13, in which:

the cutting subassembly comprises a blade defining an edge;

the edge of the blade is not exposed when the cutting subassembly is in the first position; and the edge of the blade is exposed when the cutting subassembly is in the second position.

15. A caulk working tool as recited in claim 14, in which:

the shaft member defines a blade slot; and the edge of the blade is within the blade slot when the cutting subassembly is in the first position.

16. A caulk working tool as recited in claim 15, in which:

the shaft member defines a blade opening; and the edge of the blade is within the blade opening when the cutting subassembly is in the second position.

17. A caulk working tool as recited in claim 14, in which:

the shaft member defines a blade opening; and the edge of the blade is within the blade opening when the cutting subassembly is in the second position.

18. A caulk working tool as recited in claim 13, further comprising:

at least one retaining slot formed in one of the shaft member and the cutting subassembly; and at least one retaining projection formed in another of the shaft member and the cutting subassembly.

19. A caulk working tool as recited in claim 11, in which:

a plurality of locator projections extend from the shaft member; and a plurality of locator openings is formed in the scraper body; whereby the locator projections engage the locator openings to inhibit movement of the scraper body relative to the shaft member.

* * * * *